United States Patent [19]

Davidson

[11] 4,076,997

[45] Feb. 28, 1978

[54] DIODE FEEDBACK MONOSTABLE MULTIVIBRATOR IN A TRANSISTOR IGNITION SYSTEM

[75] Inventor: John Richard Davidson, Crystal Lake, Ill.

[73] Assignee: Motorola, Inc., Schaumburg, Ill.

[21] Appl. No.: 697,512

[22] Filed: Jun. 18, 1976

[51] Int. Cl.[2] ..... H05B 37/02; H05B 39/04; H05B 41/14

[52] U.S. Cl. ..... 315/209 T; 123/148 E; 307/273; 307/292

[58] Field of Search ..... 315/209 T; 307/273, 307/292; 123/148 E

[56] References Cited

U.S. PATENT DOCUMENTS

| | | | |
|---|---|---|---|
| 3,303,353 | 2/1967 | Sacha | 307/273 |
| 3,309,528 | 3/1967 | Ziegler | 307/273 |
| 3,374,365 | 3/1968 | Lyles et al. | 307/273 |
| 3,517,220 | 6/1970 | Gibson et al. | 307/273 |
| 3,597,635 | 8/1971 | Reich | 307/292 |

*Primary Examiner*—Saxfield Chatmon, Jr.

*Attorney, Agent, or Firm*—James W. Gillman; Donald J. Lisa; Phillip H. Melamed

[57] ABSTRACT

A monostable multivibrator circuit is disclosed which uses a feedback diode to couple the output signal of the monostable back to one terminal of the timing capacitor and thereby maintain the voltage at this capacitor terminal at a constant level for a duration equal to the pulse duration of the monostable output. A transistorized internal combustion engine ignition system is illustrated which incorporates the diode feedback monostable circuit. A trigger input signal actuates a first transistor switch which creates an abrupt negative transition that is coupled across a timing capacitor and results in turning off a second transistor for a predetermined amount of time. A third transistor monitors and inverts the output of the second transistor and produces an output signal at its collector. This inverted output signal forms the output of the monostable multivibrator and this signal is fed back to one terminal of the timing capacitor by a feedback diode. Thus the present invention basically comprises a monostable multivibrator circuit having an output inverter stage in which the output of the inverter stage is coupled back to one terminal of the timing capacitor by a feedback diode.

22 Claims, 8 Drawing Figures

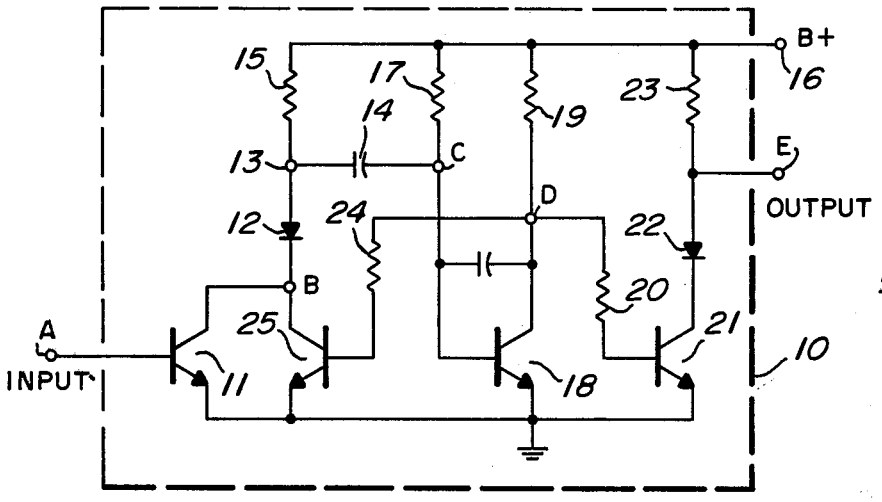
PRIOR ART
Fig. 1
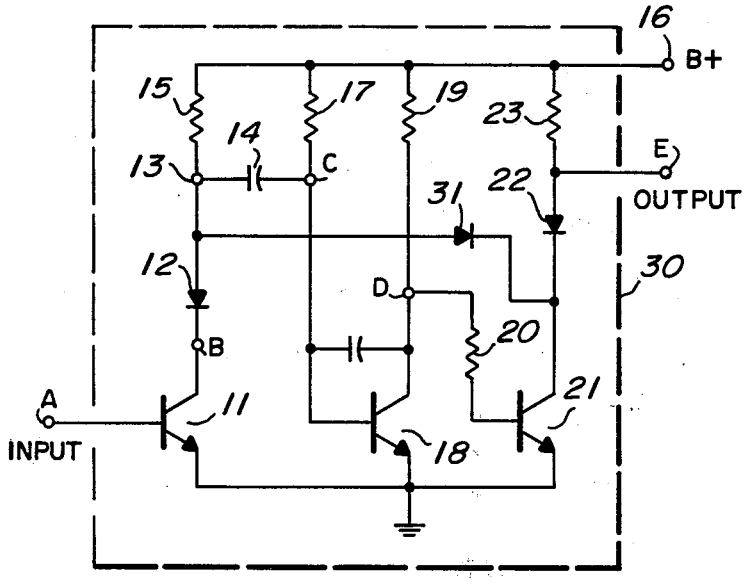
Fig. 2
Fig. 4
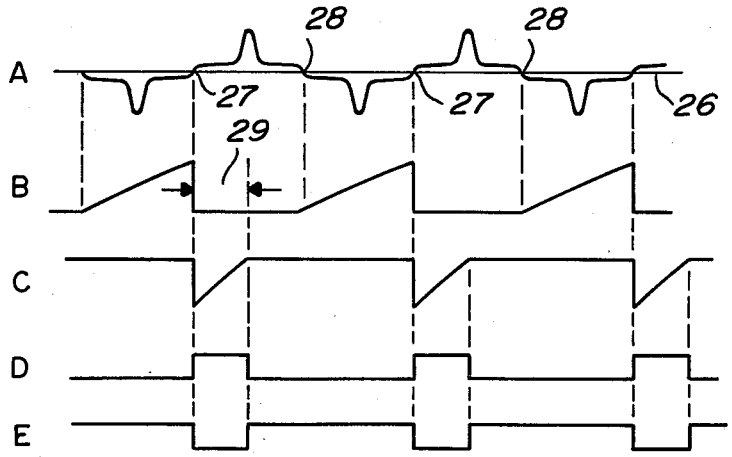

DIODE FEEDBACK MONOSTABLE MULTIVIBRATOR IN A TRANSISTOR IGNITION SYSTEM

BACKGROUND OF THE INVENTION

The present invention relates generally to the field of monostable multivibrator circuits and more particularly to the use of an improved diode feedback monostable multivibrator circuit in the ignition system of an internal combustion engine.

Monostable multivibrator circuits are well known to those of ordinary skill in the art and basically perform the function of responding to a trigger signal by producing an output pulse which has a predetermined duration. Typically, the monostable multivibrator responds to a predetermined polarity transition of the trigger signal and produces an output pulse which has a predetermined controllable duration. The term "pulse" as used herein, and as commonly used in the electronics industry, referes to a signal having abrupt (step) transitions. Thus a sine wave signal is not contemplated as being a pulse signal whereas a square wave signal does meet the definition.

Monostable multivibrators generally include input and output active devices. These devices have one inherently stable state and are triggered into a temporary unstable state in response to a trigger signal transition. The duration of the unstable state is determined by a timing capacitor and charging circuit which charge up the capacitor until a predetermined voltage threshold level is obtained, at which point the monostable reverts back to its stable state. One characteristic of such circuits is that a feedback connection is provided between one of the output terminals of the output device and a terminal of the input device. This feedback connection results in maintaining the input device in its unstable state, and thereby maintaining one terminal of the timing capacitor at a predetermined voltage level, during the duration of the monostable pulse. This prevents the monostable from responding to subsequent trigger signals which occur during the creation of the monostable pulse and prevents opposite polarity trigger signal transitions from disturbing the operation of the monostable circuit during the creation of the monostable output pulse. All of the above is well known to those of ordinary skill in the electronics art.

Monostable multivibrator circuits are generally used in electronic ignition systems for internal combustion engines. These circuits receive a timing signal from a cylinder position sensor and create predetermined variable or fixed width pulses in response thereto. These pulses are then used to control the spark timing and dwell characteristics of the electronic ignition system. One such electronic ignition system is illustrated in U.S. Pat. No. 3,933,141 to Philip Gunderson, which is assigned to the same assignee as the present invention.

In many monostable multivibrator circuit applications it is necessary to provide additional power gain stages subsequent to the monostable multivibrator. It is also occasionally desirable to provide for inverting the output signal produced by a basic two device monostable multivibrator. Thus in a great many applications, a basic two device monostable multivibrator is followed by additional stages of gain and inversion. The present invention basically deals with a novel electronic configuration in which the output of a subsequent inversion stage is fed back to the timing capacitor by a diode and thus eliminates the need for an input feedback device. This novel electronic configuration is illustrated as being adaptable for use in the electronic ignition system of an internal combustion engine.

SUMMARY OF THE INVENTION

An object of the present invention is to provide an improved and simplified electronic configuration for a monostable multivibrator circuit.

An more particular object of the present invention is to provide an improved monostable multivibrator circuit in which a feedback diode is used to couple the output signal of the monostable circuit to one terminal of the timing capacitor of the circuit.

A further object of the present invention is to provide an improved internal combustion engine ignition system which includes a diode feedback monostable multivibrator.

In one embodiment of the present invention an improved diode feedback monostable multivibrator circuit is provided. The circuit has a trigger input terminal which is adaptable for receiving a trigger signal having transitions of a predetermined polarity. A capacitor has a first terminal coupled to the trigger input terminal, and first and second current sources are coupled to the first and second terminals of the capacitor, respectively. The first and second current sources provide for charging and discharging the capacitor in response to the receipt of a trigger signal having a transition of a predetermined polarity at the trigger input terminal. A first switch, preferably a transistor, has a control terminal coupled to the second capacitor terminal and this switch is operated between on and off operative conditions in response to the receipt of the trigger signal transition by the trigger input terminal. A second switch, also preferably a transistor, has a control terminal coupled to an output terminal of the first switch, and the second switch provides an output signal at one of its output terminals which has magnitudes that correspond to each of the operative conditions of the first switch. A feedback diode is coupled between an output terminal of the second switch and the first capacitor terminal. This feedback diode provides for maintaining the first capacitor terminal at a predetermined voltage level for a predetermined duration of time after the reception of the trigger signal transition. The second current source and the capacitor help to determine the magnitude of the predetermined time duration, and the output signal of the second switch provides the output of the monostable multivibrator circuit.

Bacially, the present invention involves constructing a monostable multivibrator circuit with a subsequent inverter stage and feeding back the output signal of the inverter stage to one terminal of the timing capacitor by means of a feedback diode. Essentially, the feedback diode replaces the feedback provided by a resistor and transistor which would be series coupled between the output of the monostable circuit and one terminal of the timing capacitor. Thus a single diode has been used to replace a transistor and resistor, with a resultant decrease in the overall cost of the monostable multivibrator circuit and an inherent increase in the reliability of the circuit. The increased reliability resulting from both a reduction in the number of components used and the replacement of a three terminal switch device (transistor) by a more reliable two terminal diode device.

The diode feedback monostable multivibrator essentially uses the inverted output signal of a inverter stage subsequent to the output of a first transistor stage to provide the proper potentials to be fed back to one terminal of the timing capacitor by a diode connection. An internal combustion engine ignition system is disclosed which incorporates the diode feedback monstable multivibrator and illustrates the use of this circuit in such an electronic ignition system. The cost reduction afforded by the present invention will be significant when large quantities of the diode feedback monostable circuits are produced and the inherent reliability of the present invention provides an additional advantage.

DESCRIPTION OF THE DRAWINGS

For more complete understanding of the invention, reference should be made to the drawings, in which:

FIG. 1 is a schematic diagram of a prior art monostable multivibrator circuit;

FIG. 2 is a schematic diagram of an improved monostable multivibrator circuit which uses diode feedback;

FIGS. 4A–E are a series of graphs which illustrate typical waveforms that correspond to the voltages present at various terminals of the circuits illustrated in FIGS. 1–3.

DESCRIPTION OF THE PREFERRED EMBODIMENTS

Figure 3:
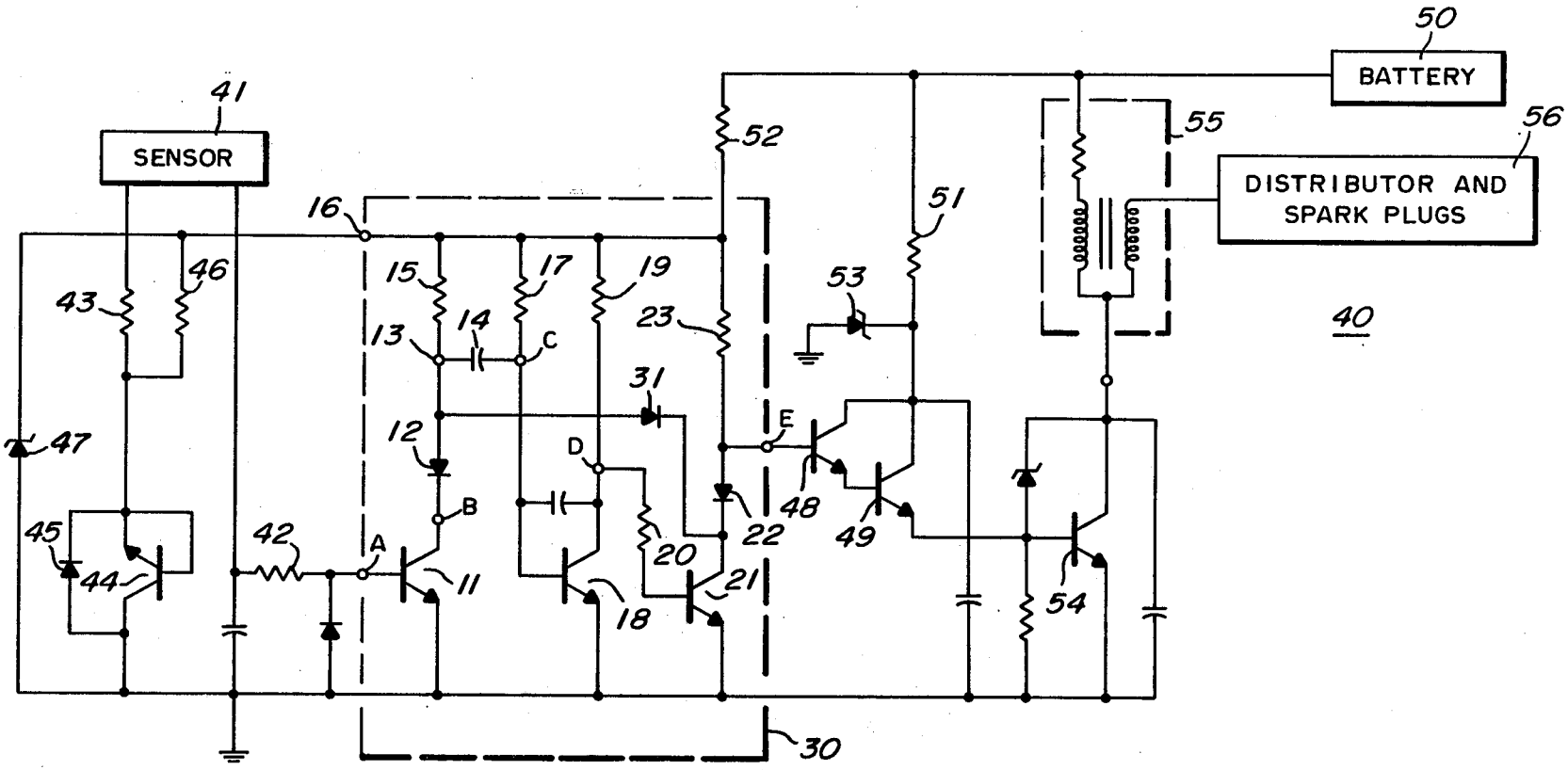
FIG. 3 is a schematic and block diagram of an internal combustion engine ignition system which incorporates the diode feedback monostable multivibrator circuit illustrated in FIG. 2.

FIG. 1 illustrates a prior art monostable multivibrator circuit 10 (shown dashed). This circuit corresponds to the multivibrator circuit shown in the electronic ignition system illustrated in U.S. Pat. No. 3,933,141. The structure and operation of the prior art circuit 10 will first be discussed in detail and subsequently by the structure and operation of the present invention will be discussed. Various terminals in the prior art circuit are designated by letters and the corresponding terminals in the circuits illustrated in FIGS. 2 and 3 will be identically designated.

The prior art multivibrator circuit 10 comprises an input trigger terminal A. The input terminal is coupled to the base of an NPN transistor 11 which has its emitter connected directly to ground and its collector connected to a terminal B. A diode 12 has its cathode directly connected to the terminal B and has its anode connected to a first terminal 13 of a timing capacitor 14 of the monostable multivibrator circuit 10. A resistor 15 is coupled between the terminal 13 and a B+ terminal 16 and basically forms a first current source for the charging of the capacitor 14. A second terminal of the timing capacitor 14 corresponds to a terminal C, and a resistor 17 is coupled between the terminal C and the terminal 16. The resistor 17 forms a second current source for discharging the capacitor 14. The terminal C is connected to the base of an NPN transistor 18 which has its emitter directly connected to ground and its collector connected to a terminal D. A resistor 19 is coupled between the terminal 16 and the terminal D and forms a current source which supplies current through the transistor 18 when this transistor is turned on. A resistor 20 is coupled between the terminal D and the base of an NPN transistor 21 which has its emitter coupled to ground and its collector to an output terminal E through a diode 22 which has its anode directly coupled to the terminal E. A resistor 23 is coupled between the terminal 16 and the terminal E and forms a current source for supplying current through the transistor 21 whenever this transistor is turned on. Signal feedback between the terminals D and B is provided by a resistor 24 coupled between the terminal D and the base of an NPN transistor 25 which has its emitter coupled to ground and its collector directly connected to the terminal B. The components 24 and 25 provide for inverting the signal present at the terminal D and presenting this inverted signal at the terminal B for a predetermined duration, and thus also effectively providing this signal at the capacitor terminal 13.

The operation of the prior art circuit 10 will now be described with reference to the graphs illustrated in FIGS. 4A–E, where the letter designating each of the graphs in FIGS. 4A–E corresponds to the waveform present at the terminals A–E in FIG. 1.

With no input signal present at the terminal A, resistor 17 biases the transistor 18 into a conductive state which in turn provides a low voltage at the terminal B and insures that the transistor 25 remains in an off operative condition. The low voltage at terminal D also results in a high voltage being present at the terminal E, since transistor 21 is also in an off operative condition. The components 12–19, resistor 24 and transistor 25 represent a basic two active device monostable multivibrator circuit in which an abrupt negative signal transition at terminals B or C, or a positive signal transistion at the base of transistor 25, will result in triggering the monostable circuit into its unstable state for a predetermined time duration. In this unstable state, transistor 18 will be non-conductive and transistor 25 will be conductive. The operation of the prior art circuit 10 is as follows.

FIG. 4A illustrates a waveform having alternate positive and negative cycles with respect to a reference level 26. The waveform has negative to positive transistions at points 27 and positive to negative transitions at points 28. Thus the waveform has both positive (rising) and negative (falling) polarity transitions about the reference level 26.

With a voltage waveform corresponding to the one shown in FIG. 4A present at the terminal A, the transistor 11 will be turned on during the positive cycle of this waveform and turned off during the negative cycle. The transistor 11 alternates between saturation and cutoff in response to the waveform 4A. In response to a negative to positive transition (27) of the waveform 4A, the terminal B will be shorted to ground. Shorting the terminal B to ground creates an abrupt (step) negative transition at this terminal and at the timing capacitor terminal 13. The basic function of the transistor 11 is to transform the transitions occurring at terminal A into abrupt transitions, since the transition at terminal A may be either abrupt or gradual. An abrupt negative transition at terminal 13 results in a negative transient voltage occuring at the terminal C, since the voltage across a capacitor can't change instantaneously, and this in turn shuts off the transistor 18 and turns on the transistors 21 and 25 by virtue of the fact that the terminal D is now at a high potential.

The voltage at the timing capacitor terminal 13 is maintained at a predetermined voltage level, one diode drop above ground potential, by transistor 25 for a predetermined duration of time after the creation of a negative step transition at terminal C. This predetermined duration of time is the time that it takes for the current source resistor 17 to charge the capacitor 14 such that the voltage at the terminal C will exceed the threshold (turn on) level of the transistor 18. Once the voltage at the terminal C exceeds this threshold level, which corresponds to the forward bias level of the base-emitter diode of transistor 18, the transistor 18 will be turned on again and the transistors 21 and 25 will be turned off. Thus the monostable will have reverted back to its original stable state. The signal at terminal D (FIG. 4D) therefore represents pulses of predetermined durations produced by the monostable in response to the positive to negative signal transitions at terminal A. The duration of pulses is determined by the capacitor 14 and resistor 17 as well as the magnitude of the negative transition created at terminal 13. The signal at the terminal D is directly related to the operative condition (on or off) of the transistor 18 which is operated between saturation and cutoff and therefore is effectively operated as a switch.

The components 20–23 basically form an inversion stage which merely inverts the signal present at the terminal D (FIG. 4D) and provides this inverted signal (FIG. 4E) at the output terminal E. This inverted signal (FIG. 4E) has magnitudes which correspond to each of the operative conditions of the transistor 18. Feedback is provided by the components 24 and 25. This feedback maintains the terminal 13 at a predetermined voltage level so that subsequent positive and negative transitions at the terminal A will not affect the output of the monostable multivibrator until the expiration of the predetermined time period duration. In the waveforms 4A-E this predetermined time period duration is designated as 29.

When the predetermined time period duration 29 has expired and the waveform at the terminal A is negative, the transistors 11 and 25 will be turned off and the voltage at the terminal B (and at the terminal 13) will begin to rise according to the RC time constant formed by the components 14 and 15. This will continue until the B+ voltage is reached or until the next negative to positive transition of a signal at the terminal A. Thus the prior art circuit 10 basically comprises a monostable multivibrator having two active devices 18 and 25, followed by an active inverting stage comprising transistor 21 and preceded by a trigger feed circuit comprising transistor 11.

FIG. 2 illustrates a diode feedback monostable multivibrator circuit 30 (shown dashed). The circuit 30 comprises all of the components 11–23 which are illustrated in the circuit 10 in FIG. 1. All of these circuit components are identically connected and numbered, and the terminals A–E are also identically designated. The circuit 30 includes a feedback diode 31 which has its anode connected to the first capacitor terminal 13 and its cathode connected to the collector of the transistor 21. The diode 31 essentially provides for feeding back the output signal of the transistor 21 to the first capacitor terminal 13. This results in creating the exact same waveforms as the prior art circuit 10. However now the resistor 24 and the transistor 25 have been eliminated and replaced by a single two terminal device, diode 31.

Essentially, the output of the inverter device 21 has been used to provide the output signal which is used to hold the terminal 13 at a predetermined voltage level for a predetermined duration of time determined by the RC time constant of the capacitor 14 and the resistor 17. Thus a fewer number of components are required by the diode feedback circuit 30 and the reliability of the circuit is increased, since a diode has a greater inherent reliability factor than a transistor.

The concept of using diode feedback will be readily applicable to any monostable multivibrator in which the output of the monostable is subsequently inverted by an inverter stage. Such will commonly be the case whenever power amplification of the output signal of the monostable is required. In addition, in many situations it is desirable to only trigger the monostable on input signal transitions which are of a single predetermined polarity wherein this polarity can not be altered at will and the resultant output waveform must correspond to a waveform having a predetermined polarity. In these cases, an additional inverter stage is again required, and again the diode output signal feedback can be advantageously used to to increase the circuit reliability and to reduce the number of components.

FIG. 3 illustrates an internal combustion engine ignition system 40 which incorporates the diode feedback monostable multivibrator circuit 30. The ignition system comprises a sensor apparatus 41, preferably a Hall or magnetic sensor, which produces an output signal which has transitions about a sensor reference level and has a frequency related to the speed of the internal combustion engine. The sensor 41 senses the cylinder positions of an internal combustion engine and has two output connections. The sensor output signal is produced on these output connections. One of these output lines is coupled through a resistor 42 to the input terminal A, whereas the other output line is coupled through a resistor 43 through a diode connected NPN transistor 44 to ground. The transistor 44 has its base directly connected to its emitter, with the emitter of the transistor being directly connected to the resistor 43, and the collector of the transistor 44 is connected to ground. A diode 45 has its anode connected to ground and its cathode connected to the emitter of the transistor 44. A resistor 46 is connected between the terminal 16 and the cathode of the diode 45, and a zener diode 47 has its anode connected to ground and its cathode connected to the terminal 16. The function of the components 41–47 is explained in detail in U.S. Pat. No. 3,933,141, and these components basically provide for temperature compensating and stabilizing the output of the sensor 41 and providing for switching the transistor 11 in response to the signal produced by the sensor 41 varying about a temperature stabilized voltage reference level.

The output terminal E of the monostable multivibrator circuit 30 is coupled as the input to a Darlington connected pair of NPN transistors 48 and 49 which have their common collectors connected to a battery 50 through a resistor 51. The battery 50 is also coupled to the terminal 16 through a resistor 52. A zener diode 53 has its cathode connected to the collectors of the transistors 48 and 49 and its anode connected to ground, and provides a stable voltage at the collectors of the Darlington connected transistors. The output of the Darlington pair is provided at the emitter of the transistor 49 which is coupled to the base of an NPN power transistor 54. The emitter of the transistor 54 is directly connected to ground and the collector is connected to a spark coil 55 between the battery 50 and the transistor 54. The spark coil 55 provides an output signal to the distributor and spark plugs, represented by block 56, of the internal combustion engine.

The operation of the components 48–56 is thoroughly described in the previously referred to U.S. Pat. No. 3,933,141 and thus will not be described in detail here. Basically these components amplify the output pulses of the monostable circuit 30 and use these amplified pulses to create inductive spark pulses which control the ignition of fuel by the engine.

Thus the present invention contemplates a novel structure for a monostable multivibrator circuit in which a feedback diode is used to maintain one terminal of a timing capacitor of the monostable at a predetermined voltage level for a predetermined duration of time.

While I have shown and described specific embodiments of this invention, further modifications and improvements will occur to those skilled in the art. All such modifications which retain the basic underlying principles disclosed and claimed herein are within the scope of this invention.

I claim:

1. A diode feedback monostable multivibrator comprising:

a trigger input terminal adaptable for receiving a trigger signal having transitions of a predetermined polarity;

a first current source means coupled to said input terminal;

a capacitor having first and second terminals, said capacitor first terminal coupled to said input terminal;

a second current source means coupled to said capacitor second terminal;

said first and second current source means alternately charging said capacitor in response to the reception by said trigger input terminal of a trigger signal having a transition of a predetermined polarity;

first switch means having first and second output terminals and a control terminal, said control terminal coupled to said capacitor second terminal, said first switch means being switched on and off operative conditions in response to the reception of said trigger signal transition by said trigger input terminal;

a second switch means having a control terminal coupled to one of said first and second output terminals of said first switch means, said second switch means having first and second output terminals and providing an output signal at one of its output terminals having magnitudes corresponding to each of the operative conditions of said first switch means; and means including a feedback diode coupled between said one of said first and second output terminals of said second switch means and said capacitor first terminal;

wherein an output pulse having a duration equal to a predetermined time is produced at said one of said first and second output terminals of said second switch means in response to a trigger signal transition of a predetermined polarity, and said diode including means provides a feedback path from said one of said first and second output terminals of said second switch means to said capacitor first terminal for maintaining said capacitor first terminal at a predetermined voltage level for a duration equal to said predetermined time after the reception of said trigger signal transition.

2. A diode feedback monostable multivibrator adaptable for use in the ignition system of an internal combustion engine, comprising:

a trigger input terminal adaptable for receiving a trigger signal having transitions of a predetermined polarity;

a first current source means coupled to said input terminal;

a capacitor having first and second terminals, said capacitor first terminal coupled to said input terminal;

a second current source means coupled to said capacitor second terminal;

a first switch means having first and second output terminals and a control terminal, said control terminal coupled to said capacitor second terminal, said first switch means having on and off operative conditions;

said first and second current source means alternately charging said capacitor in response to the receipt by said trigger input terminal of a trigger signal having a transition of a predetermined polarity, said capacitor and said second current source means determining a first predetermined time for controlling the duration of at least one of the operative conditions of said first switch means;

a second switch means having a control terminal coupled to one of said first and second output terminals of said first switch means, said second switch means also having first and second output terminals;

said second switch means producing an output signal at one of its output terminals having magnitudes corresponding to each of the operative conditions of said first switch means; and means including a feedback diode coupled between said one of said first and second output terminals of said second switch means and said capacitor first terminal for providing a feedback path from said one of said first and second output terminals of said second switch means to said capacitor first terminal for maintaining said capacitor first terminal at a predetermined voltage level for a duration equal to said first predetermined time after the occurrence of a trigger signal transition of a predetermined polarity.

3. A diode feedback monostable multivibrator according to claim 2 wherein said first switch means produces a signal at said one of its first and second output terminals which has magnitudes corresponding to the operative condition of said first switch means.

4. A diode feedback monostable multivibrator according to claim 3 wherein said signal produced by said second switch means is substantially identical to but has the opposite polarity of the signal produced by said first switch means.

5. A diode feedback monostable multivibrator according to claim 4 which includes a third switch means having first and second output terminals and a control terminal, said control terminal coupled to said trigger input terminal, one of said first and second output terminals being coupled to said capacitor first terminal, said third switch means receiving trigger signals having transitions of a predetermined polarity about a reference level and producing abrupt signal transitions at said capacitor first terminal in response thereto.

6. A diode feedback monostable multivibrator according to claim 5 wherein each of said first, second and third switch means comprise a transistor.

7. A diode feedback monostable multivibrator according to claim 6 wherein said one of said first and second output terminals of each of said first, second and third switch means corresponds to a collector electrode and wherein said diode has its anode coupled to said capacitor first terminal and its cathode coupled to the collector electrode of said second switch means.

8. A diode feedback monostable multivibrator circuit, comprising:

a trigger input terminal adaptable for receiving a trigger signal having transitions of a predetermined polarity;

a first current source means coupled to said input terminal;

a capacitor having first and second terminals, said first terminal coupled to said input terminal;

a second current source means coupled to said capacitor second terminal;

a first transistor having base, collector and emitter electrodes, said base electrode coupled to said capacitor second terminal;

a second transistor having base, collector and emitter electrodes, said base electrode coupled to one of said collector and emitter electrodes of the first transistor;

a third current source means coupled to at least one of said collector and emitter electrodes of said second transistor for supplying current through said second transistor when said second transistor is on; and means including a feedback diode coupled between said capacitor first terminal and said one of said collector and emitter electrodes of said second transistor, said first and second current source means alternately charging said capacitor in response to the receipt by said input terminal of a trigger signal having a predetermined polarity, and at least said second current source and said capacitor determining a first predetermined time for controlling the actuation of said first transistor;

wherein an output pulse having a duration equal to said first predetermined time is produced by said second transistor and said feedback diode including means said capacitor maintaining first terminal at a predetermined voltage level for a predetermined amount of time in response to the receipt of a trigger signal transition of a predetermined polarity at said trigger input terminal.

9. A diode feedback monostable multivibrator circuit according to claim 8 wherein said one of said collector and emitter electrodes of said first transistor is said collector electrode and wherein said one of said collector and emitter electrodes of said second transistor is said collector electrode.

10. A diode feedback monostable multivibrator circuit according to claim 8 which includes a fourth current source means coupled to at least one of the collector and emitter electrodes of said first transistor for supplying current through said first transistor when said first transistor is on.

11. A diode feedback monostable multivibrator circuit according to claim 10 which includes a third transistor having base, collector and emitter electrodes, said base electrode coupled to said trigger input terminal, one of said collector and emitter electrodes being coupled to said capacitor first terminal, whereby said third transistor acts as a switch device and produces abrupt transitions at said capacitor first terminal in response to transitions of a predetermined polarity about a reference level occurring at said trigger input terminal.

12. A diode feedback monostable multivibrator circuit according to claim 11 wherein said one of said collector and emitter electrodes of said first transistor is said collector electrode and wherein said one of said collector and emitter electrodes of said second transistor is said collector electrode.

13. A diode feedback monostable multivibrator circuit according to claim 12 wherein said one of said collector and emitter electrodes of said third transistor is said collector electrode.

14. A diode feedback monostable multivibrator circuit according to claim 13 wherein said diode has its anode coupled to said capacitor first terminal and its cathode coupled to the collector electrode of said second transistor.

15. A diode feedback monostable multivibrator circuit according to claim 14 which includes a voltage source having two terminals and wherein said first, second and third current sources each comprise a corresponding resistor coupled to one terminal of said voltage source.

16. A diode feedback monostable multivibrator circuit according to claim 15 wherein the emitter electrodes of said first, second and third transistors are coupled to another terminal of said voltage supply.

17. An ignition system for an internal combustion engine comprising in combination:

sensor means for producing a signal having transitions about a reference level and a frequency related to the speed of an engine; and an ignition circuit means for receiving said sensor signal and producing a signal for controlling the ignition of fuel by the engine;

said ignition circuit means including a diode feedback monostable multivibrator circuit comprising:

a trigger input terminal coupled to said sensor means for receiving said sensor signal;

a first current source means coupled to said input terminal;

a capacitor having first and second terminals, said capacitor first terminal coupled to said input terminal;

a second current source means coupled to said capacitor second terminal;

a first switch means having first and second output terminals and a control terminal, said control terminal coupled to said capacitor second terminal, said first switch means having on and off operative conditions;

said first and second current source means alternately charging said capacitor in response to the receipt by said trigger input terminal of a sensor signal having a transition of a predetermined polarity about said reference level, said capacitor and said second current source means determining a first predetermined time for controlling the duration of at least one of the operative conditions of said first switch means;

a second switch means having a control terminal coupled to one of said first and second output terminals of said first switch means, said second switch means also having first and second output terminals;

said second switch means producing an output signal at one of its output terminals having magnitudes corresponding to each of the operative conditions of said first switch means; and means including a feedback diode coupled between said one of said first and second output terminals of said second switch means and said capacitor first terminal for providing a feedback path for said output signal from said one of said first and second output terminals of said second switch means to said capacitor first terminal for maintaining said capacitor first terminal at a predetermined voltage level for a duration equal to said first predetermined time after the occurrence of a trigger signal transition of a predetermined polarity about said reference level, said output signal being used to control the fuel ignition of the engine.

18. An ignition system for an internal combustion engine according to claim 17 wherein said first switch means produces a signal at said one of said first and second output terminals of said first means which has magnitudes corresponding to the operative conditions of said first switch means.

19. An ignition system for an internal combustion engine according to claim 18 wherein said signal produced by said second switch means is substantially identical to but has the opposite polarity of the signal produced by said first switch means.

20. An ignition system for an internal combustion engine according to claim 19 which includes a third switch means having first and second output terminals and a control terminal, said control terminal coupled to said trigger input terminal, one of said first and second output terminals being coupled to said capacitor first terminal, said third switch means receiving trigger signals having transitions of a predetermined polarity about said reference level and producing abrupt signal transitions at said first capacitor terminal in response thereto.

21. An ignition system for an internal combustion engine according to claim 20 wherein each of said first, second and third switch means comprise a transistor.

22. An ignition system for an internal combustion engine according to claim 21 wherein said one of said first and second output terminals of each of said first, second and third switch means corresponds to a collector electrode and wherein said diode has its anode coupled to said first capacitor terminal and its cathode coupled to the collector electrode of said second switch means.

* * * * *